US010273950B2

(12) United States Patent
Buckberry et al.

(10) Patent No.: US 10,273,950 B2
(45) Date of Patent: Apr. 30, 2019

(54) PERISTALTIC PUMP ROTOR

(71) Applicant: Quanta Fluid Solutions Ltd., Alcester (GB)

(72) Inventors: Clive Buckberry, Warwick (GB); David Spurling, Leamington Spa (GB)

(73) Assignee: Quanta Dialysis Technologies Limited, Warwickshire (GB)

( * ) Notice: Subject to any disclaimer, the term of this patent is extended or adjusted under 35 U.S.C. 154(b) by 790 days.

(21) Appl. No.: 14/432,677

(22) PCT Filed: Oct. 4, 2013

(86) PCT No.: PCT/GB2013/052599
§ 371 (c)(1),
(2) Date: Mar. 31, 2015

(87) PCT Pub. No.: WO2014/053858
PCT Pub. Date: Apr. 10, 2014

(65) Prior Publication Data

US 2015/0252800 A1 Sep. 10, 2015

(30) Foreign Application Priority Data

Oct. 4, 2012 (GB) ..... 1217798.6

(51) Int. Cl.
*F04B 43/00* (2006.01)
*F04B 43/12* (2006.01)

(52) U.S. Cl.
CPC ..... *F04B 43/1276* (2013.01); *F04B 43/0081* (2013.01); *F04B 43/1253* (2013.01); *F04B 43/1261* (2013.01)

(58) Field of Classification Search
CPC .. F04B 43/12; F04B 43/1253; F04B 43/1276; F04B 43/0081; F04B 43/08
(Continued)

(56) References Cited

U.S. PATENT DOCUMENTS 2,696,173 A 12/1954 Jensen
4,070,725 A 1/1978 Austin et al.
(Continued)

FOREIGN PATENT DOCUMENTS

DE 3940730 A1 6/1991
EP 0 690 962 6/1995
(Continued)

OTHER PUBLICATIONS

Apr. 7, 2015 International Preliminary Report on Patentability for PCT/GB2013/052599.

*Primary Examiner* — Philip E Stimpert
(74) *Attorney, Agent, or Firm* — Hahn Loeser & Parks LLP

(57) ABSTRACT

A peristaltic pump rotor comprising a body, an arm pivotally mounted to the body at an arm-body pivot point, the arm being movable between a deployed condition in which the arm is arranged, in use, to contact tubing in a peristaltic pump so as to effect pumping, and a retracted condition in which the arm is withdrawn from the tubing so that pumping is not effected; an actuator for effecting movement of the arm between the deployed and retracted conditions, the actuator comprising a first link pivotally mounted to the body at one end thereof and to a second link at the other end thereof, the second link being pivotally mounted to the first link at one end thereof and to the arm at the other end thereof at a point on the arm spaced from the arm-body pivot point; the links and pivot points being arranged such that the arm is retained in the deployed condition by the first and second links being arranged over center when the arm is in the deployed condition.

31 Claims, 6 Drawing Sheets

(58) Field of Classification Search
USPC ..... 417/477.8
See application file for complete search history.

(56) References Cited

U.S. PATENT DOCUMENTS

| | | | | |
|---|---|---|---|---|
| 4,142,845 | A * | 3/1979 | Lepp | A61M 1/30 251/9 |
| 4,564,342 | A | 1/1986 | Weber et al. | |
| 5,586,872 | A | 12/1996 | Skobelev et al. | |
| 5,586,873 | A | 12/1996 | Novak et al. | |
| 6,626,878 | B1 | 9/2003 | Leisner et al. | |
| 6,645,176 | B1 | 11/2003 | Christenson et al. | |
| 6,733,476 | B2 | 5/2004 | Christenson et al. | |
| 6,743,204 | B2 | 6/2004 | Christenson et al. | |
| 7,434,312 | B2 | 10/2008 | Christenson et al. | |
| 2009/0269228 | A1 | 10/2009 | McIntosh | |
| 2014/0044579 | A1 * | 2/2014 | Al-Hawaj | F04B 43/1253 418/45 |

FOREIGN PATENT DOCUMENTS

| | | | |
|---|---|---|---|
| EP | 0 685037 | | 6/1995 |
| EP | 2 113 668 | | 11/2009 |
| GB | 2412698 | | 10/2005 |
| JP | 59-074387 | A | 4/1984 |
| JP | 10-037860 | A | 2/1998 |
| JP | 3106980 | B2 | 5/1998 |
| WO | WO 91/16542 | | 10/1991 |
| WO | WO 97/28368 | | 8/1997 |
| WO | WO 02/066833 | | 8/2002 |
| WO | WO 2005/080794 | | 9/2005 |
| WO | WO 2008/135245 | A1 | 11/2008 |

* cited by examiner

PERISTALTIC PUMP ROTOR

The present application is a US National Stage of international application no. PCT/GB2013/052599, filed on 4 Oct. 2013 and published in the English language on 10 Apr. 2014 with publication no. WO 2014/053858 A1, which claims the benefit of the filing date of GB 1217798.6, filed 4 Oct. 2012.

FIELD OF INVENTION

The invention relates to a peristaltic pump rotor and a peristaltic pump comprising the same which can be used to pump fluid through tubing.

BACKGROUND TO THE INVENTION

Peristaltic pumps are a common type of pump used across a range of commercial settings. The mechanism by which fluid is pumped involves successive compression along the length of some form of tubing to drive the fluid along the tube.

A common mechanism to provide this successive compression force is trapped tubing in a pump race, a hollow chamber having a U-shaped end, between a rotors having a plurality of protrusions and the wall of the pump race. As such, when the rotor is turned, the protrusions of the rotor compress a portion of tubing and move along the tubing, squeezing the contained fluid along.

Various designs for pump rotors have been developed to improve the ease of use and smoothness of pumping some of which are described below.

U.S. Pat. No. 5,462,417A discloses a peristaltic pump having a pump rotor rotatable about an axis. The pump rotor carries a pump roller and there is described a system for deploying and retracting the protrusions on the rollers. WO9116542A discloses a peristaltic pump wherein the protrusions on the rotor are maintained in the operative or pumping position by means of a tension spring. During operation of the pump connecting mechanism can be brought into a position where the protrusions do not squeeze shut or deform the tube and the tube can permit a cleaning fluid to pass through it. US2010047100A discloses a tube pump rotor including a rotor element a plurality of first swing portions supported pivotally at their base. This allow the rollers to move outwards on operation of the rotor.

There is a need for a system which rigidly holds the arms in position once deployed, is easy to use and can also be operated manually to provide manual pumping.

The invention is intended to provide an improved peristaltic pump rotor.

SUMMARY OF THE INVENTION

There is provided in a first aspect of the invention a peristaltic pump rotor comprising a body, an arm pivotally mounted to the body at an arm-body pivot point, the arm being movable between a deployed condition in which the arm is arranged, in use, to contact tubing in a peristaltic pump so as to effect pumping, and a retracted condition in which the arm is withdrawn from the tubing so that pumping is not effected; an actuator for effecting movement of the arm between the deployed and retracted conditions, the actuator comprising a first link pivotally mounted to the body at one end thereof and to a second link at the other end thereof, the second link being pivotally mounted to the first link at one end thereof and to the arm at the other end thereof at a point on the arm spaced from the arm-body pivot point; the links and pivot points being arranged such that the arm is retained in the deployed condition by the first and second links being arranged over centre when the arm is in the deployed condition.

Employing this configuration provides numerous advantages including ease of removal and insertion into the pump rotor. This is especially useful when the machine requires cleaning and cleaning fluid is required to be flushed through the apparatus.

The over centre arrangement of the links and pivot points prevents the arm from collapsing back to the retracted condition as the reaction force applied against the arm, by the tubing when the device is in use, is directed through the first and second links in the opposite direction required to push the arm back over the centre point and back into the retracted position. This stops the arm retracting and keeps the arm in a rigid and stable deployed configuration.

The arm may be spring loaded to allow for tolerances, to enhance tube life, to reduce deployment forces (due to tube crushing) and to provide over-pressure relief within the tubing.

It is often the case that the length of the second link is adjustable. This allows the position of the arm relative to the tube to be altered but retain the rigid characteristics provided by the over centre arrangement. Accordingly, the position of the arm can be calibrated to provide optimum pumping in pumps having a variety of differently sized tubing and pump races. There is no particular limitation on the way the length of the second link can be altered. Typically, the second link comprises, between the second link-first link and second link-arm pivot points, a first portion having a threaded bore and a second portion comprising a threaded rod arranged to adjust the length of the second link by rotating the rod relative to the bore. Alternatively, the second link may comprise one or more removable segments, there may be a plurality of holes and a pin arrangement in the first and second portions respectively or a ratchet like mechanism arranged to increase and/or decrease the length of the second link by incremental distances.

The threaded bore and rod arrangement is typically used as it allows continuous variations to be made to the length of the second link by effecting turning of the rod.

Typically, the second link may comprise a resilient means arranged to urge the first and second portions apart. This may, for example, be a helical spring. This resilience provides tension through the length of the second link and helps to maintain rigidity of the second link.

Often, the rotor further comprises a handle portion which is connected to the actuator. This allows the actuator to be easily rotated by hand to effect manual movement of the arm between the deployed condition and a retracted condition. The handle portion may be used to effect manual pumping by rotating the pump rotor using the handle portion. This is particularly useful if power to the peristaltic pump fails.

The handle portion is typically operated by rotating the handle portion. The handle portion is arranged such that rotating the handle portion in one direction causes deployment of the arm and rotation in the other direction causes retraction of the arm.

Typically, manual pumping is effected by rotating the handle portion in the same direction required to retract the arm. Accordingly, the rotor may further comprise a locking mechanism, which is operable to prevent movement of the arm between the deployed condition and the retracted condition on operation of the handle. This arrangement is such that it prevents the arm from inadvertently retracting during manual rotation of the rotor. This is particularly important with certain peristaltic pumps, such as those in dialysis machines which require continuous pumping to prevent downstream complications.

The locking mechanism is typically arranged to lock when the arm in the deployment condition. It is not so important to lock the device in the retracted position as the arm of the rotor is not engaged with tubing of the peristaltic pump and is therefore not effecting pumping.

The locking mechanism may comprise a guide track in the body comprising walls having one or more indentations, a moveable pin located within the guide track arranged to cooperate with the one or more indentations and a resilient means arranged to urge the pin against the wall of the guide track, wherein in use, the pin travels along the guide track on operation of the handle and the locking mechanism becomes locked when the pin is urged into an indentation in the wall of the guide track.

The movable pin and the resilient means are typically attached or form part of the handle portion. The locking mechanism typically further comprises a means to unlock the locking mechanism. As such, when the pump rotor is required to be removed, the lock can be disengaged and the handle portion can be operated to retract the arm. Although not particularly limited, It is usually the case that the locking mechanism comprises a button or switch which is operable to disengage the pin from the indentation in the wall of the guide track to unlock the locking mechanism.

The button or switch may have an indication as to the state of the locking mechanism, showing whether or not the locking mechanism is engaged.

The arm of the rotor may comprise at least one roller arranged to contact the tubing in the peristaltic pump. This prevents the arms from catching on portions of the tubing and allows smooth uniform pumping.

It is often the case that the rotor comprises two arms on opposite sides of the body. This allows constant contact of the rotor with the tubing in a typical U-shaped pump race.

There is also provided in a second aspect of the invention, a peristaltic pump comprising the rotor of the first aspect of the invention.

The invention will now be described with reference to the accompanying drawings.

DESCRIPTION

Figure 1:
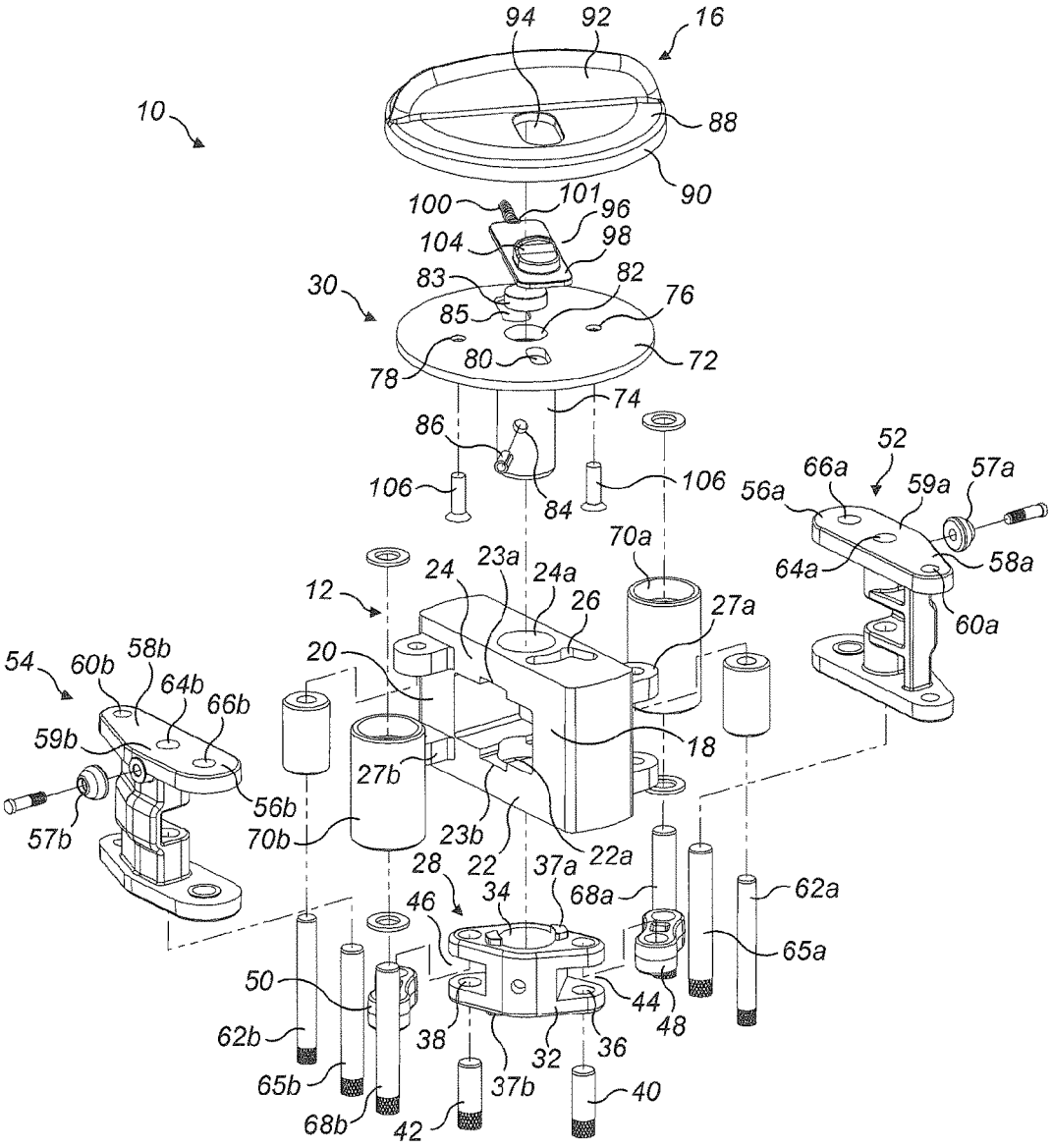
FIGS. 1 is an exploded view of the pump rotor.

In FIG. 1, a pump rotor 10 in accordance with the first aspect of the invention comprises a rotor body 12, a pump arm arrangement 14 and a rotor handle 16. The pump arm arrangement 14 is mounted between the rotor body 12 and the rotor handle 16.

The rotor body 12, comprises two spaced apart upright beams 18, 20, and lower and upper cross beams 22, 24 defining a central space. Each of the cross beams 22, 24 has a bore 22*a*, 24*a* formed therethrough, the bores being coaxial. The upper beam 24 has a channel 23*a* formed on the underside thereof extending transverse to the beam. The lower beam 22 has a channel 23*b* formed on the upper surface thereof, parallel to and directly beneath the channel in the upper beam. The lower beam has a keyed recess 25 (see FIG. 4*f*) formed on either side of the bore 24*a*. The keyed recess receives a key formation on the drive shaft of a peristaltic pump so that the drive shaft and rotor body 12 are rotationally fast one with the other. The upper beam 24 has a cam track recess 26 formed in the upper surface thereof adjacent the bore 24*a*. Two arm mounting lugs 27*a*, 27*b* extend from opposite diagonal corners of the lower and upper beams 22, 24.

The pump rotor 10 comprises a linkage arrangement 28 and a spigot part 30.

The linkage arrangement 28 comprises a link actuator member 32 which is deep lozenge-shaped with a large central bore 34 and smaller bores 36, 38 at the opposite ends thereof. This is the common actuator link of two opposite four bar linkages. Two upstanding pairs of pips 37*a*, 37*b* extend from the upper and lower surface of the link actuator member 32, on opposite sides of the central bore 34 and diagonally offset with respect to the centre line of the link actuator member 32. The smaller bores 36, 38 each receive pins 40, 42 to form pivots 44, 46. Links 48, 50 are respectively pivotally mounted to the pivots 44, 46 so that the link actuator member 32 has a link at each end thereof.

A deployable arm member 52 is pivotally attached to the lug 27*a*. A deployable arm member 54 is pivotally attached to the lug 27*b*. Each arm member 52, 54 comprises upper arm part 56*a*, 56*b* and lower arm parts 58*a*, 58*b* connected by a bridge portion 59*a*, 59*b*. Each lower arm part 58*a*, 58*b* has a bore 60*a*, 60*b* at one end to receive a pin 62*a*, 62*b* which effects the pivot to the respective lug 27*a*, 27*b*. A central bore 64*a*, 64*b* is formed generally centrally of each arm member 52, 54 and receives a pivot pin 65*a*, 65*b*. A distal bore 66*a*, 66*b* is formed through each upper arm part 56*a*, 56*b* at the end of the respective arm part spaced from the pivot to the lug 27*a*, 27*b*. Pins 68*a*, 68*b* extends through the distal bores 66*a*, 66*b* in the upper arm parts 56*a*, 56*b* and rollers 70*a*, 70*b* are pivotally mounted between the arm parts 56*a*, 56*b* by the pin 68*a*, 68*b*. Each arm member 52, 54 also comprises a mini-roller 57*a*, 57*b* fixed to the bridge portion 59*a*, 59*b* facing outward.

The ends of the links 48, 50 spaced from the link actuator member 32 are pivotally connected to respective arm members 52, 54 by means of the pivot pin 65*a*, 65*b* through the central bores 64*a*, 64*b*.

When the link arrangement 28 is assembled together, the link actuator member 32 is received in the central space defined by the beams 18, 20, 22, 24 of the rotor body 12. The arm members 52, 54 are pivoted at one end to the rotor body at the lugs 27*a*, 27*b* and to the links 48,50 generally centrally of the arm members. This creates an effective four bar linkage arrangement on each side of the pump rotor. The four bars are formed as follows; i) link actuator member from central bore 34 to smaller bore 36, ii) link 48, iii) arm member 52 from central bore 64*a* to pivot mounting to lug 27*a*, and iv) lug 27*a* to central bore 34 of actuator member 32.

Employing a four bar linkage of this type means that the device can be held in a deployed configuration by virtue of the linkage arrangements and so does not collapse when the rotor is turned in either direction. The force applied to the arms by the tubing or pump race against which the arm abuts, forces the four bar linkage arrangement into the overcentre arrangement, thereby maintain the arm in a deployed condition.

The spigot part 30 comprises a circular base 72 with a depending central hollow spigot 74. The circular base 72 has two diametrically opposed screw holes 76, 78 and a cam slot 80 formed therethrough. A latch rod channel 85 is formed in the upper surface of the base 72 colinear with and diametrically opposed to the cam slot 80. Also a central recess 82 is provided in the surface of the circular base 72 opposite to the spigot 74. A circular magnet 83 is received in the central recess 82. The spigot 74 has a radial bore 84 formed therein approximately half way along the length of the spigot 74. A split pin 86 is received in the radial bore 84.

The rotor handle 16 comprises a main circular body 88 with a depending perimeter skirt 90 and a hand grip part 92 projecting from the upper surface of the body 88. A latch slot 94 is formed through the body, extending radially and generally perpendicular to the hand grip part 92. A channel formation 93 extends downwardly from the underside of the circular body at right angles to the hand grip part diametrically opposed to the latch slot 94 (see FIG. 4*e*). A latch arrangement 96 comprises a latch plate 98 with a rod 100 extending from one end thereof. A compression spring 101 is arranged around the rod 100 and projects from the end thereof in its extended state. The plate 98 further comprises a depending cam 102 and, on the opposite face thereof, a finger grip 104. The rotor handle 16 is screwed to the spigot part 30 by screws 106 passing through the screw holes 76, 78 and into the main circular body 88 of the handle 16. The latch plate 98 is arranged between the circular base 72 of the spigot part 30 and the circular body 88 of the handle 16. The rod 100 is received in a channel defined by the recess 85 and the channel formation 93 so that the latch plate 98 can slide radially of the circular base 72 against the action of the compression spring 101. The cam 102 extends through the cam slot 80 in the base 72 of the spigot part and is received in the cam track recess 26 in the rotor body 12. The finger grip 104 projects through the latch slot 94 in the main circular body 88 of the handle 16.

The spigot 74 of the spigot part 30 passes through the bore 24*a* in the upper cross beam 22 of the rotor body, through the central bore 34 in the link actuator member 32 and through the bore 22*a* in the lower beam 22 of the rotor body 12. The split pin 86 passes through an aperture in the link actuator member 32 into the radial bore 84 in the spigot 74 so as to secure the spigot 74 to the link actuator member 32 against relative rotation. The magnet 83 magnetically attracts the end of the drive shaft of the pump when it is received in the hollow spigot 74 so as to secure the spigot part 30 onto the end of the shaft.

The locking mechanism of the rotor is best described with reference to FIG. 1. Latch arrangement 96 comprises a cam 102 protruding below the finger portion 104 through the cam slot 80 and into the cam track recess 26 defined in upper cross beam 24. The cam track recess 26 curves across the upper cross beam concentrically relative to the central axis defined by bore 24*a*. At one end of the cam track recess 26, the track changes direction and moves radially outwards, away from the central bore 24*a*. The finger portion 104 is urged radially outwards in the direction perpendicular to the hand grip portion, i.e. radially away from the axis defined by the central bore 24*a*, by a rod 100 and helical spring 101.

Accordingly, as the spigot portion 30 rotates within the rotor body 12, the pin (not shown) moves in the cam recess track 26 until the cam track recess 26 changes direction. At this point, the tension in the helical spring 101 forces the pin into the end of the cam track recess 26 thus prevent radial movement of the pin relative to the central bore 24*a* along the cam track recess 26 in the manner of a bayonet fixing. This consequently prevents the handle portion 16 from turning relative to the rotor body 12. Further rotation of the handle portion 16 simply rotates the entire pump rotor 10.

Figure 2A:
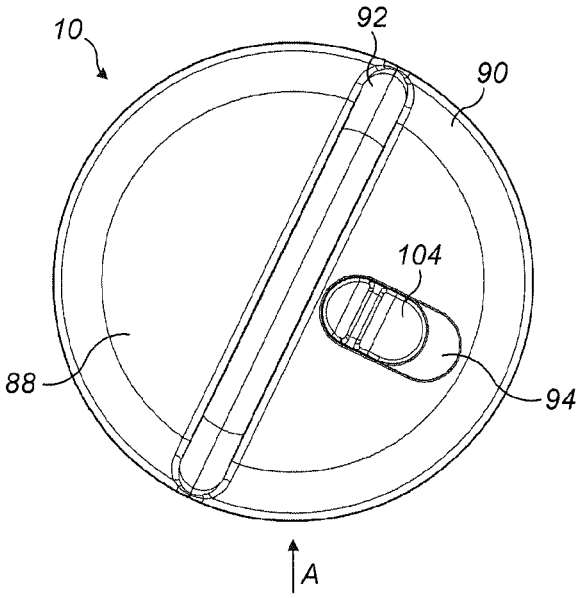
FIGS. 2*a* and 2*b* are top down views of the pump rotor in the retracted and deployed conditions respectively, FIGS. 3*a* and 3*b* side views of the pump rotor in the retracted and deployed conditions respectively.
Figure 2B:
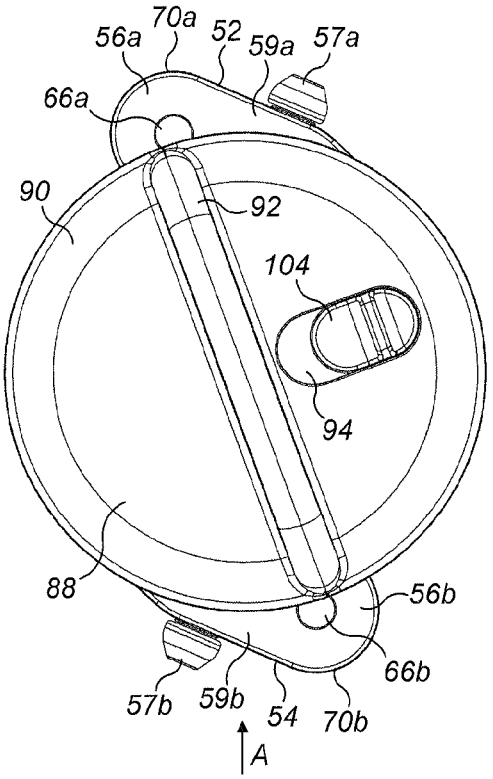

FIGS. 2*a* and 2*b* show the pump rotor 10 as viewed from above in the retracted and deployed condition respectively. The hand grip part 92 of the handle rotor 16 is position along and fully across a diameter of the circular body 88 of the rotor handle 16. The latch slot 94 of the latch arrangement 96 is positioned perpendicular to the hand grip part 92 extends radially outwards towards the skirt 90 of the circular body 88. Finger portion 104 is shown positioned at one end of the latch slot 94 nearest the hand grip part 92. The latch plate 98 is moveable in the direction perpendicular to the hand grip part 92 along the latch slot 94 and the latch plate 98 lying beneath the circular body 88 of handle portion 16 is visible through the portion of latch slot 94. The portion of the latch plate 98 visible through the latch slot 94 comprises two indicators (not shown) such that one of the indicators is visible through the portion of latch slot 94 when the finger portion is at one end of the latch slot 94. When the finger portion 104 is located at the end of the latch slot 94 furthest most from the hand grip 92, the indicator visible through the portion of the latch slot 94 not obscured by the finger portion 104 shows that the rotor is locked. When the finger portion 104 is at the other most end of the latch slot 94, the indicator shows that the rotor is unlocked.

In the deployed configuration (FIG. 2*b*) the arm members 52, 54 protrude beyond the perimeter defined by circular body 88 and skirt 90. Mini-rollers 57*a*, 57*b* located on the arm members 52,54 are positioned on the outer face of the bridging portion 59*a*, 59*b* of the arm members 52,54 and are level. i.e. in the same horizontal plane as upper beam 24 of rotor body 12 (not shown). The mini rollers 57*a*, 57*b* serve to retain the peristaltic pump tubing in place when the pump rotor is rotating. In the deployed configuration, the finger portion 104 is urged towards the end of latch slot 94 by a compression spring 101 (not shown) which locks the deployable arms 52, 54 into the deployed configuration.

Figure 3A:
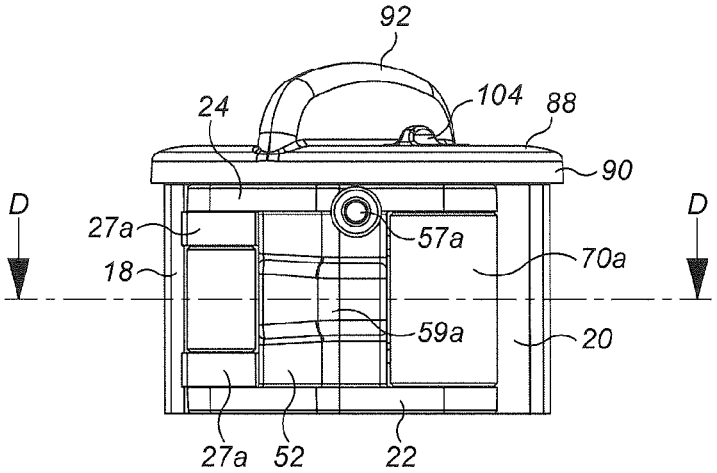
Figure 3B:
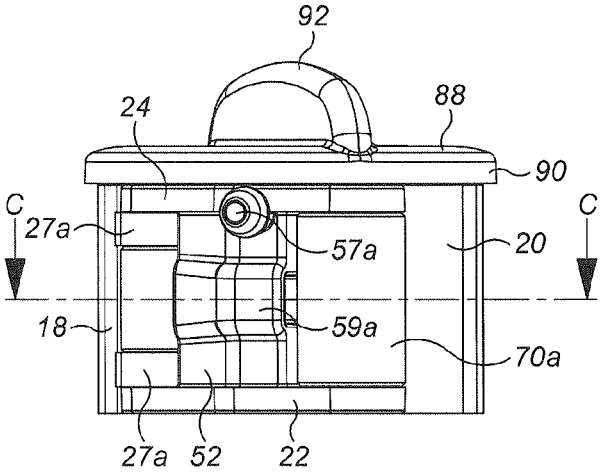

Turning now to FIGS. 3*a* and 3*b*, the handle portion 16 as described for FIGS. 2*a* and 2*b* forms the top most portion of the pump rotor. The arm member 52 has a roller 70*a* positioned at the distal end 56*a* of the device forward along the arm member 52 of the mini-roller 57*a* situated on the bridging portion 59*a* of arm member 52. In the retracted condition the arm member 52 is within the perimeter defined by the circular body 88 and skirt 90 of the handle portion 16 and the roller is in contact with a cross beam 20 of rotor body 12.

Figure 4A:
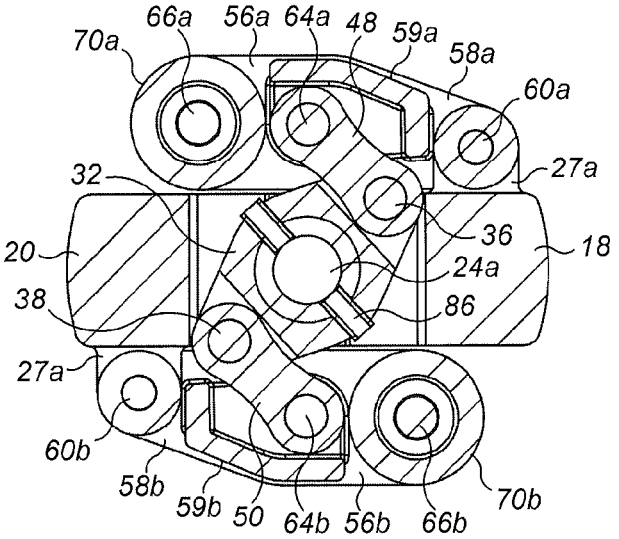
FIGS. 4*a* and 4*b* are cross-sectional views taken through the pump rotor along lines D-D in FIG. 3*a* and C-C in FIG. 3*b* respectively.
Figure 4B:
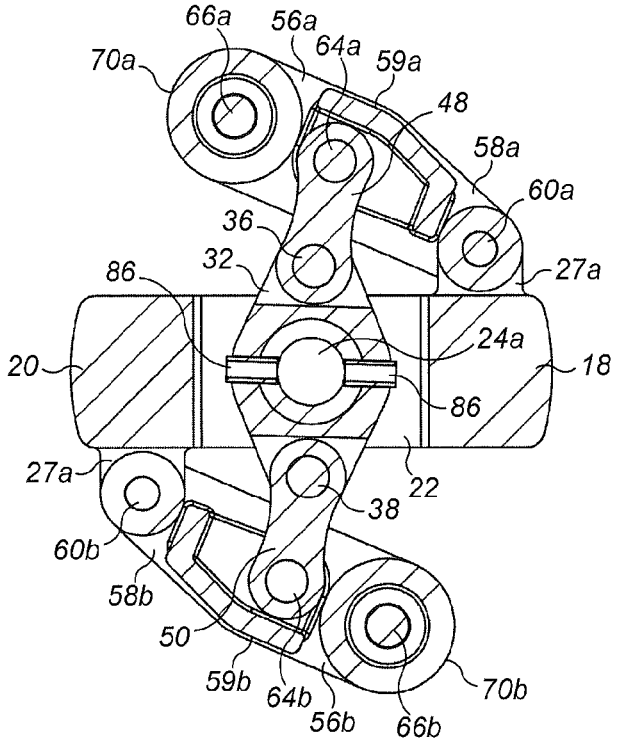
Figure 4C:
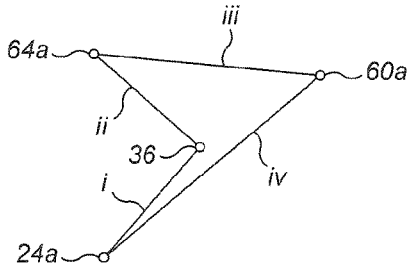
FIGS. 4*c* and 4*d* are schematic representations of the link arrangement used in the invention.
Figure 4D:
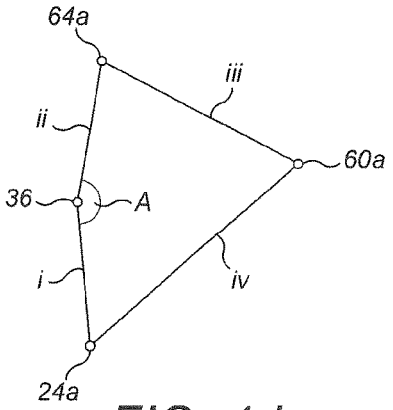
Figure 4E:
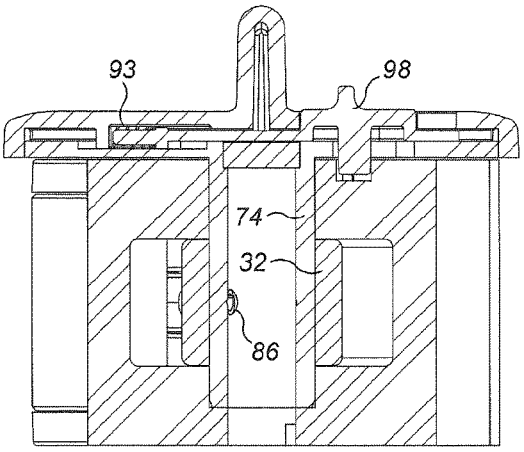
FIG. 4*e* is a cross section through the pump rotor of FIG. 1.
Figure 4F:
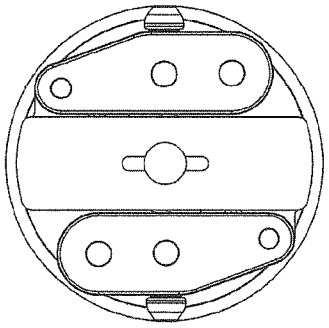
FIG. 4*f* is a view of the underside of the pump rotor of FIG. 1, and FIGS. 5*a* to 5*c* are plan views and a perspective view respectively of an adjustable link which may be used in the pump rotor.

The interrelationship between the arm member 52, 54 link arrangement 28 and rotor body 12 of the pump rotor 10 in the retracted and deployed configurations is visible in FIGS. 4*a* and 4*b* respectively. The link actuator member 32 is positioned with the cavity defined by upright beams 18 and 20 such that the length of the link actuator 32 is across the diagonal of the cavity. One of the two pairs of upstanding pips 37*a* are located in upper channels 23*a* of cross beam 24 (not shown). Links 48, 50 are attached at either end of the link actuator 32 and held in place by pins 40, 42 positioned in bores 36 and 38 allowing the links 48, 50 to pivot relative to the central axis of the bores 36, 38. The opposite end of the links 48, 50 the links are pivotally attached to the arm members 52, 54 by pins 65*a*, 65*b* through 64*a*, 64*b*. The arm members 52, 54 are also attached at end 58*a*, 58*b* of the arm members 52, 54 to the rotor body 12 by means of mounting lugs 27*a*, 27*b* and pins 62*a*, 62*b* to form a further pivot point for the arm members 52, 54.

As best seen in FIGS. 4*a* to 4*d*, rotation of the link actuator 32 in an anticlockwise direction relative to the upright beams 18, 20 about the central axis of bore 24*a* causes the links 48, 50 to extend outwards away from the link actuator 32 and to be rotated in the clockwise direction. As the arm member 52 in pivot point 60*a* is a fixed distance relative to the bore 24*a*, the rotation of the link actuator 32 and link 48, pushes the deployable arms 52, 54 outwards away from the rotor body 12. As best illustrated in the schematic FIGS. 4*c* (retracted condition) and 4*d* (deployed condition), when deployed, the links i) and ii) (actuator member 32 and link 48, 50) move past an aligned position into an over centre position where those links delimit an angle A of approximately 170 degrees. As such, in the deployed configuration, the pivot point about bores 36 and 38 is over centre with respect to pivots about bores 64*a* and 64*b* and the central pivot point about bore 24*a*. The pips 37*a*, 37*b* abut opposite side edges of the channels 23*a*, 23*b* to prevent over-rotation of the link actuator 32.

The over-centre configuration of the linkage arrangement is advantageous as the drag forces applied to the ends of the arm members 52, 54 when the pump is operated tend to push the linkage further into the over-centre position. In that way, actuation of the pump, further secures the arms in the deployed condition. When the roller 70*a* on one of the arm members 52 moves out of contact, in use, with the tube while in the deployed condition then the opposite arm member is moving into contact. This means that in the deployed condition there is always a force pushing the linkage into the aforesaid over centre condition. As the link actuator member 32 is common to both linkages, the forces acting to push the linkage into the over centre condition apply a twisting force to the link actuator member 52 which holds the other linkage in the over centre condition while the roller 70*a* on that arm member remains out of contact.

Figure 5A:
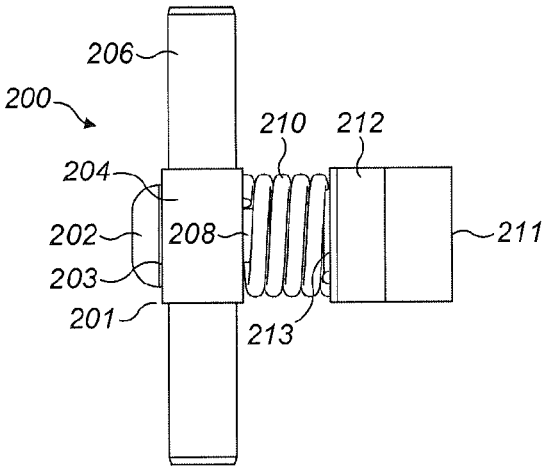
Figure 5B:
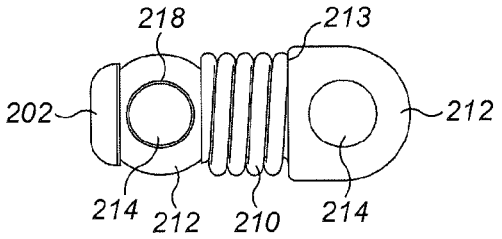
Figure 5C:
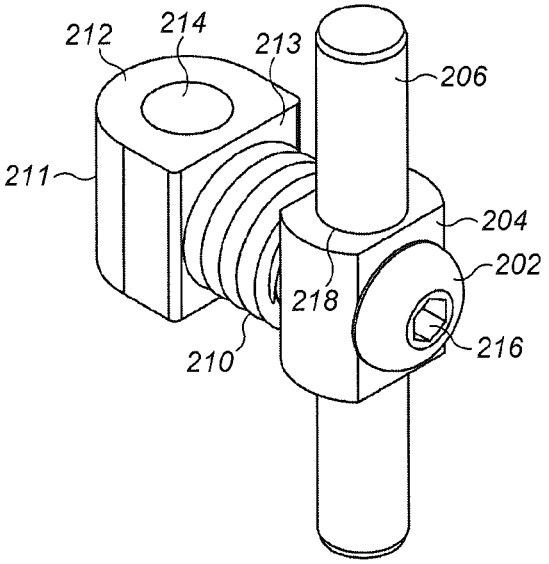

The links 48, 50 may be replaced with an adjustable link arrangement 200 as shown in FIGS. 5*a*-5*c*. The adjustable link arrangement 200 includes a lug 212 having a rounded end 211 and a bore 214 located in the centre of lug 212. Bore 214 is intended to co-operate with the link actuator 32 via the bores 36, 38 at both ends of the link actuator 32 and pins 40 and 42, thus forming pivot points 44 and 46 (as shown in FIG. 1). Extending from the flat end 213 of the lug 212 is a cylindrical member 215 (not shown) having a threaded bore 217 along the length of the cylindrical member 215 (not shown). The threaded bore 217 is concentrically positioned relative to the central axis of the cylindrical member 215. A helical spring 210 is positioned around the external circumference of the cylindrical member 215 which abuts against the flat end 213 of the lug 212.

A screw 202 having a head portion 203, threaded shank 205 (not shown) and hexagonal indentation 216 to facilitate turning is received into the threaded bore 217. A washer portion 201 having a body 204 including a first bore 207 (not shown) is positioned between the head portion 203 of the screw 202 and the flat end 213 of the lug 212 such that the screw passes through the first bore 207 and the helical spring 210 also abuts against the body 204 of the washer portion 201. The body 204 of the washer portion 201 is spaced from the end of the cylindrical member 215 (not shown), providing a gap. The threaded shank 205 co-operates with the threaded bore 217 and the screw 202 such that the size of the gap can be adjusted by tightening or loosening the screw 202.

The body 204 of the washer portion 201 also includes a second bore 218 having a longitudinal axis perpendicular to the longitudinal axis of the first bore 207 through which a pin 206 is positioned. The pin 206 includes a aperture 220 (not shown) passing through the pin 206 perpendicular to the longitudinal axis of the pin 206. The aperture 220 is the same size and shape as the first bore 207 and is aligned with the first bore 207 such that the screw passes through both the first bore 207 and the aperture 220. This pin 206 takes the place of pins 65*a*, 65*b* shown in FIG. 1.

The pump rotor can be manufactured using a variety of techniques known to the skilled person but it is typically the case that the pump rotor and the component making up the pump rotor are made by injection moulding processes.

Unless otherwise stated each of the integers described in the invention may be used in combination with any other integer as would be understood by the person skilled in the art.

The invention claimed is:

1. A peristaltic pump rotor comprising:

a body;

a first arm pivotally mounted to the body at a first arm-body pivot point, the first arm being movable between a deployed condition in which the first arm has a tube contact part which is arranged, in use, to contact tubing in a peristaltic pump so that pumping would be effected, and a retracted condition in which the tube contact part is arranged to be withdrawn from the tubing so that pumping would not be effected;

an actuator for effecting movement of the first arm between the deployed and retracted conditions, the actuator comprising a first link pivotally mounted to the body at one end thereof about a first link-body pivot point and pivotally mounted to a second link at the other end thereof about a second pivot point, the second link being pivotally mounted to the first link at one end thereof about the second pivot point and pivotally mounted to the first arm at the other end thereof about a third pivot point, the third pivot point being at a point on the first arm spaced from the arm-body pivot point;

wherein there is a first four bar linkage arrangement comprising four links being defined by the first link, the second link, the first aim forming the third link, and that part of the body between the first arm-body pivot point and the first link-body pivot point forming the fourth link, the first four bar linkage arrangement defining respective internal angles between pairs of the links joined at the pivot points; the first four bar linkage arrangement being arranged such that the second pivot point passes across a straight line between the first link-body pivot point and the third pivot point when the first arm moves from the retracted condition to the deployed condition, resulting in an over centre configuration wherein each of the internal angles within the first four bar linkage arrangement is less than 180 degrees when the first arm is in the deployed condition.

2. A rotor according to claim 1, wherein a length of the second link is adjustable.

3. A rotor according to claim 2, wherein the second link comprises, between the second and third pivot points, a first portion having a threaded bore and a second portion comprising a threaded rod arranged to adjust the length of the second link by rotating the rod relative to the bore.

4. A rotor according to claim 3 further comprising a resilient means arranged to urge the first and second portions apart.

5. A rotor according to claim 4, wherein the resilient means is a helical spring.

6. A rotor according to claim 1 further comprising a handle portion which is connected to the actuator.

7. A rotor according to claim 6, wherein the rotor further comprises a locking mechanism, which is operable to prevent movement of the first arm between the deployed condition and the retracted condition on operation of the handle.

8. A rotor according to claim 7, wherein the locking mechanism is arranged to lock when the first arm is in the deployed condition.

9. A rotor according to claim 7, wherein the locking mechanism comprises:

a guide track in the body comprising walls having one or more indentations;

a moveable pin located within the guide track arranged to cooperate with the one or more indentations; and a resilient means arranged to urge the pin against one of the walls of the guide track;

wherein, in use, the pin travels along the guide track on operation of the handle and the locking mechanism becomes locked when the pin is urged into one of the indentations in the one of the walls of the guide track.

10. A rotor according to claim 7, wherein the locking mechanism further comprises means to manually unlock the locking mechanism.

11. A rotor according to claim 9, wherein the locking mechanism further comprises a button or switch which is operable to disengage the pin from the one of the indentations in the one of the walls of the guide track to unlock the locking mechanism.

12. A rotor according to claim 1, wherein the first arm comprises at least one roller arranged to contact the tubing in the peristaltic pump.

13. A rotor according to claim 1, comprising a second arm on an opposite side of the body as the first arm.

14. A peristaltic pump rotor comprising:

a body;

a first arm pivotally mounted to the body at an arm-body pivot point, the first arm being movable between a deployed condition in which the first arm has a tube contact part which is arranged, in use, to contact tubing in a peristaltic pump so that pumping would be effected, and a retracted condition in which the tube contact part is arranged to be withdrawn from the tubing so that pumping would not be effected;

an actuator for effecting movement of the first arm between the deployed and retracted conditions, the actuator comprising a first link pivotally mounted to the body at one end of thereof about a first link-body pivot point and pivotally mounted to a second link at the other end thereof about a second pivot point, the second link being pivotally mounted to the first link at one end thereof about the second pivot point and pivotally mounted to the first arm at the other end thereof about a third pivot point, the third pivot point being at a point on the first arm spaced from the arm-body pivot point;

the links and pivot points being arranged such that the arm is retained in the deployed condition by the second pivot point passing across a straight line between the first link-body pivot point and the third pivot point when the first arm moves from the retracted condition to the deployed condition resulting in an over centre configuration; and wherein the tube contact part comprises a projection which extends from the third pivot point away from the arm-body pivot point generally in line with a straight line from the arm-body pivot point to the third pivot point.

15. A rotor according to claim 14, wherein a length of the second link is adjustable.

16. A rotor according to claim 15, wherein the second link comprises, between the second and third pivot points, a first portion having a threaded bore and a second portion comprising a threaded rod arranged to adjust the length of the second link by rotating the rod relative to the bore.

17. A rotor according to claim 16 further comprising a resilient means arranged to urge the first and second portions apart.

18. A rotor according to claim 17, wherein the resilient means is a helical spring.

19. A rotor according to claim 14 further comprising a handle portion which is connected to the actuator.

20. A rotor according to claim 19, wherein the rotor further comprises a locking mechanism, which is operable to prevent movement of the first arm between the deployed condition and the retracted condition on operation of the handle.

21. A rotor according to claim 20, wherein the locking mechanism is arranged to lock when the first arm is in the deployed condition.

22. A rotor according to claim 20, wherein the locking mechanism comprises:

a guide track in the body comprising walls having one or more indentations;

a moveable pin located within the guide track arranged to cooperate with the one or more indentations; and a resilient means arranged to urge the pin against one of the walls of the guide track;

wherein, in use, the pin travels along the guide track on operation of the handle and the locking mechanism becomes locked when the pin is urged into one of the indentations in the one of the walls of the guide track.

23. A rotor according to claim 20, wherein the locking mechanism further comprises means to manually unlock the locking mechanism.

24. A rotor according to claim 22, wherein the locking mechanism further comprises a button or switch which is operable to disengage the pin from the one of the indentations in the one of the walls of the guide track to unlock the locking mechanism.

25. A rotor according to claim 14, wherein the first arm comprises at least one roller arranged to contact the tubing in the peristaltic pump.

26. A rotor according to claim 14 comprising a second arm on an opposite side of the body as the first arm.

27. A rotor according to claim 1, wherein the tube contact part comprises a projection which extends from the third pivot point away from the first arm-body pivot point generally in line with a straight line from the first arm-body pivot point to the third pivot point.

28. A rotor according to claim 1, in which the rotor further comprises:

a second arm arranged, with respect to the body, on an opposite side of the body from the first arm; and a second four bar linkage arrangement defined, by a first link, a second link, the second arm forming a third link, and that part of the body between a second arm-body pivot point and the first link-body pivot point forming a fourth link of the second four bar linkage arrangement, the respective first links of the first and second four bar linkage arrangements comprising a common single link pivotable about the common first link-body pivot point, and the respective fourth links of the first and second four bar linkage arrangements comprising a common single link pivotable about the common first link-body pivot point.

29. A peristaltic pump rotor configured to be mountable upon a drive shaft of a peristaltic pump, the rotor comprising:

two tube contacting parts arranged on opposite sides of the rotor with respect to each other, each tube contacting part being movable between a deployed condition in which the tube contacting part is arranged to contact, in use, a tube of the peristaltic pump so that pumping would be effected and a retracted condition in which the tube contacting part is arranged to retract so that pumping would not be effected, each tube contacting part being movable between the deployed and retracted conditions by a respective four bar linkage, each four bar linkage being arranged in an over centre position when the respective tube contacting part is in the deployed condition;

the four bar linkages comprising:

a common driving link drivable by means of the drive shaft;

a common actuating link pivotable relative to the drive shaft;

first and second tube contact links on opposite sides of the rotor, the tube contacting parts extending from the respective tube contact links; and first and second connector links;

the first tube contact link pivotable at a first end thereof to a first end of the driving link, and pivotable at a second end thereof to a first end of the first connector link about a first arm-connector pivot point;

the first connector link being pivotable at a second end thereof to a first end of the actuator link about a first actuator-connector pivot point;

the second tube contact link pivotable at a first end thereof to a second end of the driving link, and pivotable at a second end thereof to a first end of the second connector link about a second arm-connector pivot point;

the second connector link being pivotable at a second end thereof to a second end of the actuator link about a second actuator-connector pivot point.

30. A peristaltic pump comprising the rotor according to claim 1.

31. A rotor according to claim 29, wherein the over centre position of each four bar linkage results from the respective actuator-connector pivot point passing across a straight line between the respective arm-connector pivot points when the respective tube contacting part moves from the retracted condition to the deployed condition.

* * * * *